US005836401A

United States Patent [19]

Hsiu-Tsu

[11] Patent Number: 5,836,401

[45] Date of Patent: Nov. 17, 1998

[54] DRIVING MECHANISM FOR A PNEUMATIC TOOL

[75] Inventor: Wang Lin Hsiu-Tsu, Taichung Hsien, Taiwan

[73] Assignee: Shiuh Horng Air Tool Corp., Taiwan

[21] Appl. No.: 864,809

[22] Filed: May 29, 1997

[51] Int. Cl.[6] ..... B25D 15/00

[52] U.S. Cl. ..... 173/93; 173/93.5

[58] Field of Search ..... 173/93, 93.5, 93.6, 173/104, 218, 171

[56] References Cited

U.S. PATENT DOCUMENTS

| | | | |
|---|---|---|---|
| 1,391,723 | 9/1921 | Du Sell | 173/93 |
| 2,373,664 | 4/1945 | Emery | 173/93.5 |
| 3,187,865 | 6/1965 | Blachowski | 173/93 |
| 4,836,296 | 6/1989 | Biek | 173/93.5 |
| 5,080,181 | 1/1992 | Tatsuno | 173/93.5 |
| 5,645,130 | 7/1997 | Schoeps | 173/93 |

*Primary Examiner*—Scott A. Smith
*Attorney, Agent, or Firm*—Harness, Dickey & Pierce, P.L.C.

[57] ABSTRACT

A driving mechanism for a pneumatic tool includes a motor and an elongated connector. The motor has a body portion and a rotor shaft mounted rotatably to the body portion. The rotor shaft has an engaging section which extends beyond the body portion. The engaging section of the rotor shaft has an externally threaded portion adjacent to the body portion and a non-threaded portion which is connected to and which extends away from the externally threaded portion. The connector has first and second ends and an axial hole extending from the first end of the connector. The axial hole has an internally threaded section formed adjacent to the first end of the connector and a non-threaded section which is connected to the internally threaded section and which extends away from the first end toward the second end of the connector. The externally threaded portion of the rotor shaft engages threadedly the internally threaded section of the connector. The non-threaded portion of the rotor shaft engages fittingly the non-threaded section of the connector.

3 Claims, 5 Drawing Sheets

DRIVING MECHANISM FOR A PNEUMATIC TOOL

BACKGROUND OF THE INVENTION

1. Field of the Invention

This invention relates to a driving mechanism, more particularly to a driving mechanism of a pneumatic tool.

2. Description of the Related Art

Referring to FIGS. 1 and 2, a conventional driving mechanism for a pneumatic tool 10 is shown to comprise a motor 11 and an elongated connector 18. The motor 11 has a body portion 12 and a rotor shaft 14 mounted rotatably to the body portion 12. The rotor shaft 14 has an engaging section 141 which extends beyond the body portion 12. The engaging section 141 of the rotor shaft 14 has an externally threaded end 142. The connector 18 has first and second ends 181, 182 and an axial hole 183 extending from the first end 181 thereof. The axial hole 183 has an internally threaded section 184 formed adjacent to the first end 181 of the connector 18. The externally threaded end 142 of the rotor shaft 14 engages threadedly the internally threaded section 184 of the axial hole 183 so that the connector 18 is rotatable with the rotor shaft 14 when the motor 11 is actuated.

Although the threads of the externally threaded end 142 of the rotor shaft 14 and the internally threaded section 184 of the axial hole 183 are formed to have the same pitch in order to match one another perfectly, a clearance (d) (about 0.02–0.03 mm) is usually formed between the threads of the rotor shaft 14 and the connector 18 due to the processing tolerance. Therefore, when an excessively large torsional force or striking force is exerted onto the connector 18, the axis of the connector 18 is liable to be offset from that of the rotor shaft 14, thereby resulting in vibration of the connector 18 and the pneumatic tool 10.

SUMMARY OF THE INVENTION

The main object of the present invention is to provide a driving mechanism for a pneumatic tool which has a connector that is rotatable coaxially and stably with a rotor shaft of a motor thereof.

Accordingly, the driving mechanism for a pneumatic tool of the present invention comprises a motor and an elongated connector. The motor has a body portion and a rotor shaft mounted rotatably to the body portion. The rotor shaft has an engaging section which extends beyond the body portion. The engaging section of the rotor shaft has an externally threaded portion adjacent to the body portion and a non-threaded portion which is connected to and which extends away from the externally threaded portion. The connector has first and second ends and an axial hole extending from the first end thereof. The axial hole has an internally threaded section formed adjacent to the first end of the connector and a non-threaded section which is connected to the internally threaded section and which extends away from the first end of the connector toward the second end of the connector. The externally threaded portion of the rotor shaft engages threadedly the internally threaded section of the axial hole while the non-threaded portion of the rotor shaft engages fittingly the non-threaded section of the axial hole. Therefore, the connector can be rotated coaxially and stably with the rotor shaft when the motor is actuated.

BRIEF DESCRIPTION OF THE DRAWINGS

Other features and advantages of this invention will become apparent in the following detailed description of the preferred embodiments of this invention with reference to the accompanying drawings, in which.

DETAILED DESCRIPTION OF THE PREFERRED EMBODIMENTS

Figure 1:
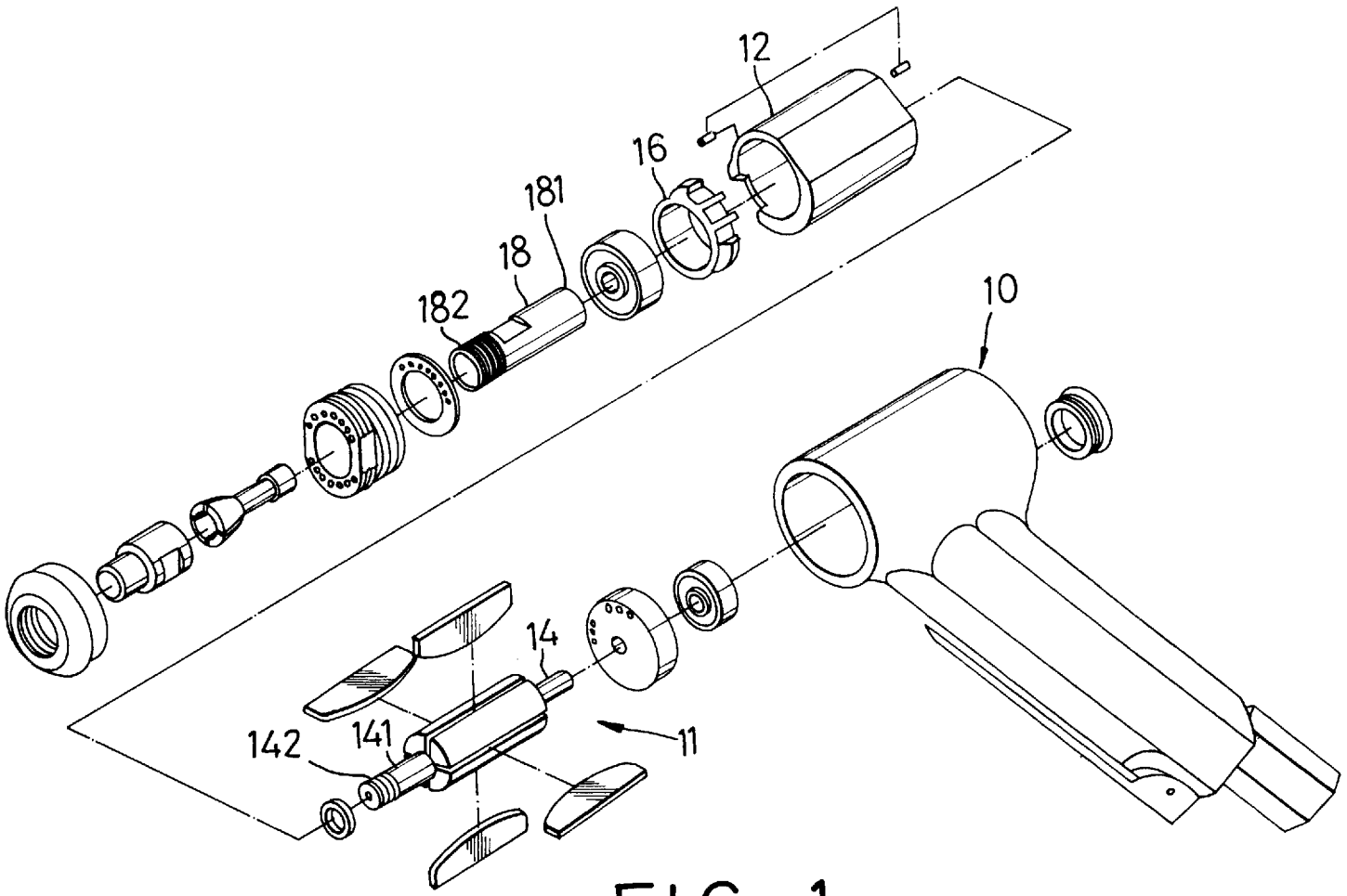
FIG. 1 PRIOR ART
FIG. 1 is an exploded view of a pneumatic tool with a conventional driving mechanism.
Figure 2:
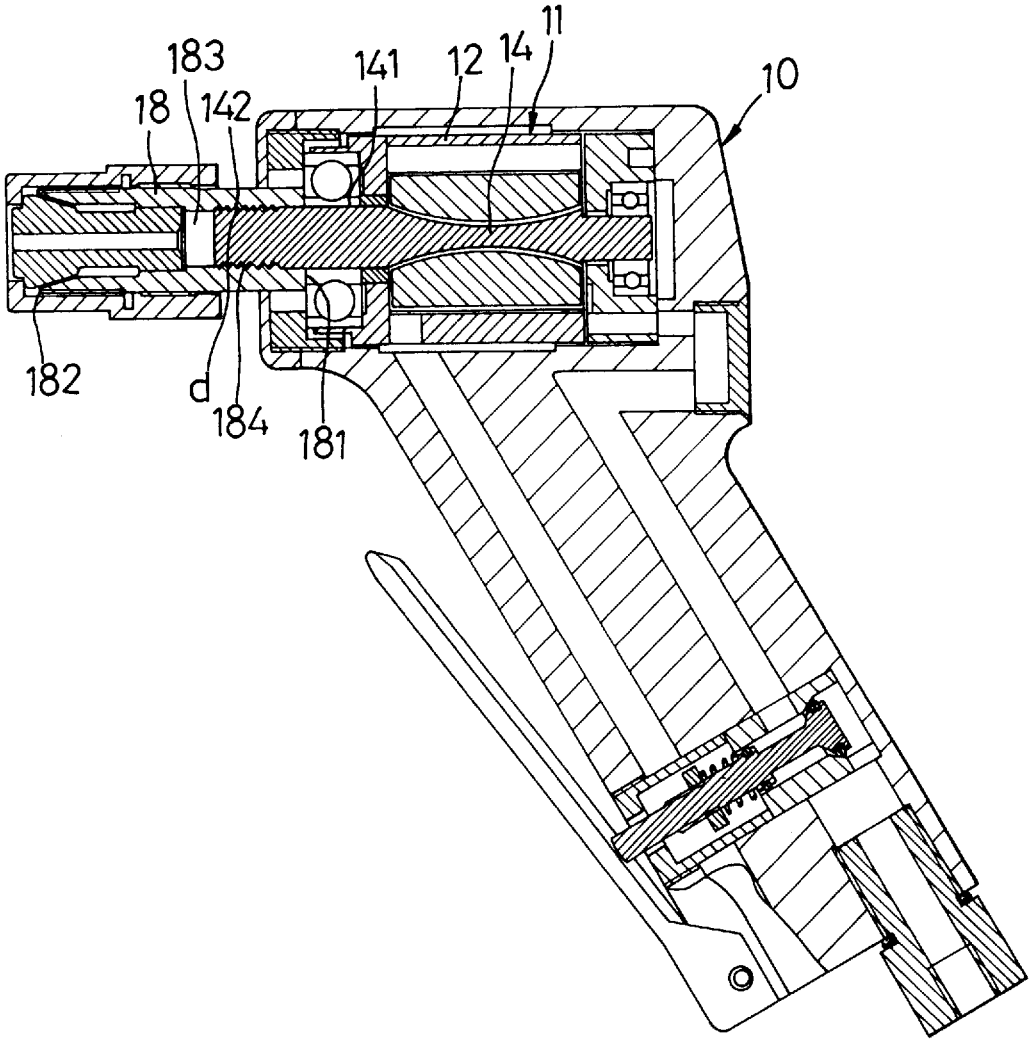
FIG. 2 PRIOR ART
FIG. 2 is a cross sectional view of the pneumatic tool of FIG. 1.
Figure 3:
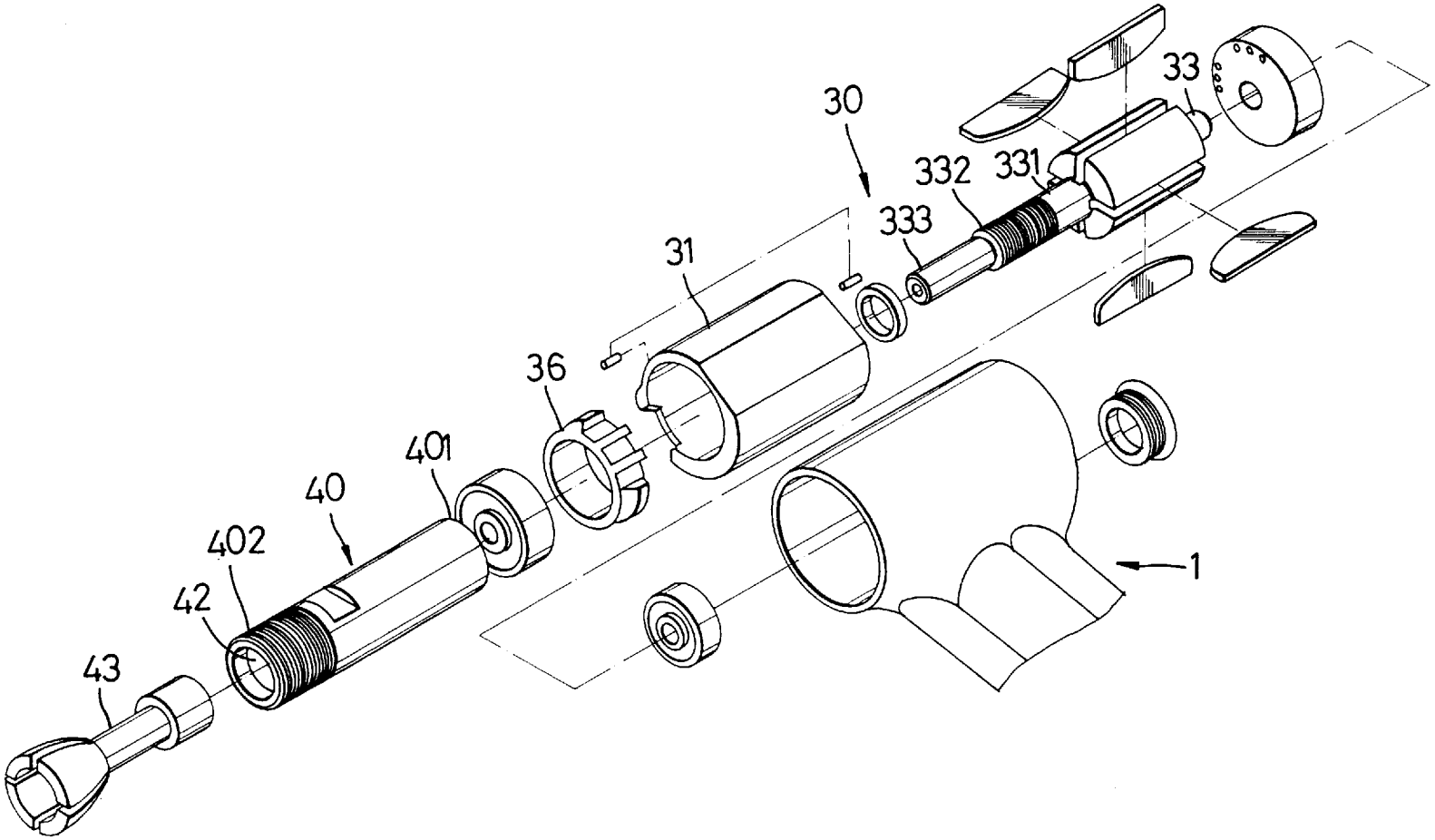
FIG. 3 is an exploded view of a pneumatic tool which incorporates a preferred embodiment of a driving mechanism according to the present invention.
Figure 4:
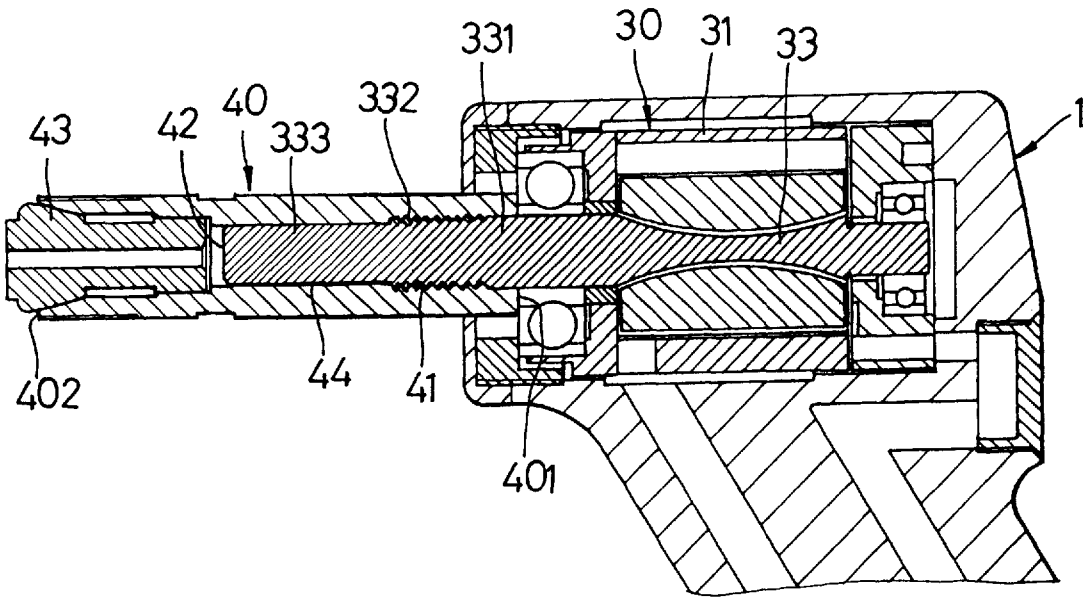
FIG. 4 is a cross sectional view of the pneumatic tool of FIG. 3 to illustrate the preferred embodiment in greater detail.

Referring to FIGS. 3 and 4, a preferred embodiment of a driving mechanism for a pneumatic tool 1 is shown to comprise a motor 30 and an elongated connector 40. The motor 30 has a body portion 31 and a rotor shaft 33 mounted rotatably to the body portion 31. The rotor shaft 33 has an-engaging section 331 which extends beyond the body portion 31. The engaging section 331 of the rotor shaft 33 has an externally threaded portion 332 adjacent to the body portion 31 and a non-threaded portion,333 which is connected to and which extends away from the externally threaded portion 332.

The connector 40 has first and second ends 401, 402 and an axial hole 42 extending from the first end 401 thereof. The axial hole 42 has an internally threaded section 41 formed adjacent to the first end 401 of the connector 40 and a non-threaded section 44 which is connected to the internally threaded section 41 and which extends away from the first end 401 toward the second end 402 of the connector 40. The externally threaded portion 332 of the rotor shaft 33 engages threadedly the internally threaded section 41 of the connector 40. The non-threaded portion 333 of the rotor shaft 33 engages fittingly the non-threaded section 44 of the connector 40. A collet 43 is fitted into the second end 402 of the connector 40. It is found that the connector 40 can be rotated coaxially and stably with the rotor shaft 33 when the motor 30 is actuated by virtue of the firm engagement between the non-threaded portion 333 and the non-threaded section 44 even though an excessive torsional force and/or striking force is exerted onto the connector 40. Therefore, the service life of the pneumatic tool 1 can be increased by eliminating the vibration produced from the motor 30.

Figure 5:
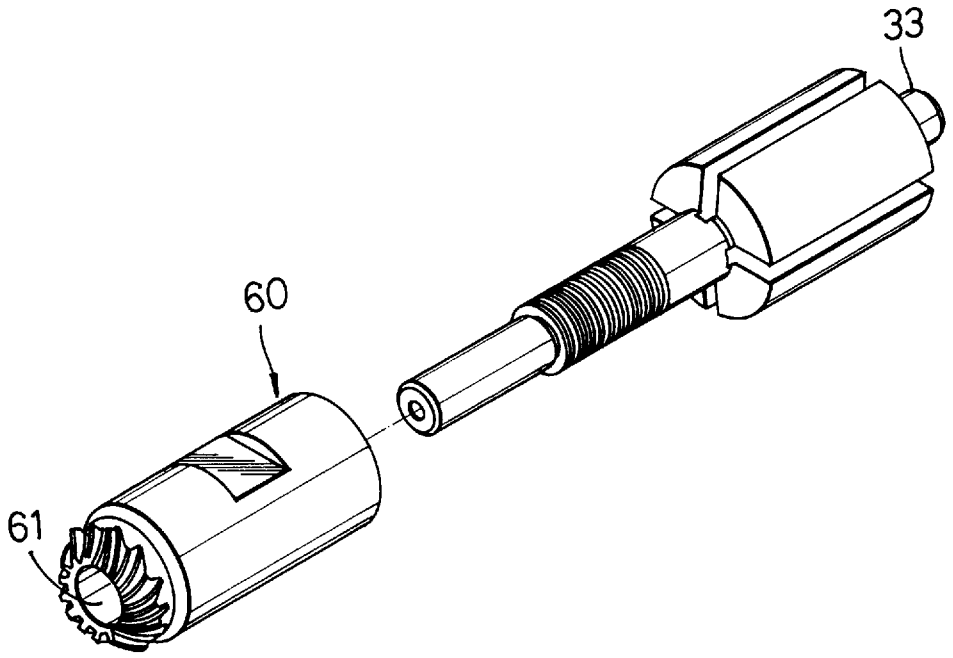
FIG. 5 is an exploded view illustrating another preferred embodiment of a connector of a driving mechanism for a pneumatic tool according to the present invention.

FIG. 5 illustrates another preferred embodiment of a connector 60 of a driving mechanism according to the present invention. The connector 60 is connected to the rotor shaft 33 in a similar manner as described hereinbefore. In this embodiment, the structure of the connector 60 is similar to that of the connector 40 of the first embodiment, except that a bevel gear 61 is connected to the second end of the connector 60.

With this invention thus explained, it is apparent that numerous modifications and variations can be made without departing from the scope and spirit of this invention. It is therefore intended that this invention be limited only as indicated in the appended claims.

I claim:

1. A driving mechanism for a pneumatic tool, comprising:

a motor having a body portion and a rotor shaft mounted rotatably to said body portion, said rotor shaft having an engaging section which extends beyond said body portion, said engaging section of said rotor shaft having an externally threaded portion adjacent to said body portion and a non-threaded portion which is connected to and which extends away from said externally threaded portion; and an elongated connector having first and second ends and an axial hole extending from said first end thereof, said axial hole having an internally threaded section formed adjacent to said first end of said connector and a non-threaded section which is connected to said internally threaded section and which extends away from said first end of said connector toward said second end of said connector, said externally threaded portion of said rotor shaft engaging threadedly said internally threaded section of said connector, said non-threaded portion of said rotor shaft engaging fittingly said non-threaded section of said connector, whereby that said connector is rotatable coaxially and stably with said rotor shaft when said motor is actuated.

2. The driving mechanism for a pneumatic tool as claimed in claim 1, wherein said second end of said connector has a collet connected thereto.

3. The driving mechanism for a pneumatic tool as claimed in claim 1, wherein said second end of said connector has a bevel gear connected thereto.

* * * * *